US005187814A

United States Patent [19]

Gold

[11] Patent Number: 5,187,814

[45] Date of Patent: Feb. 23, 1993

[54] GLOVE WITH ATTACHED HEATER PACK

[76] Inventor: Danny Gold, 27 Barker Road, Apt. E-2, Hong Kong, Hong Kong

[21] Appl. No.: 731,431

[22] Filed: Jul. 17, 1991

[51] Int. Cl.[5] ..... A41D 19/00

[52] U.S. Cl. ..... 2/160; 2/164

[58] Field of Search ..... 2/158, 159, 160, 161 A, 2/20, 239, 161 R, 16

[56] References Cited

U.S. PATENT DOCUMENTS

| | | | |
|---|---|---|---|
| 1,504,836 | 8/1924 | Rehn | 2/160 |
| 1,970,081 | 8/1934 | Eisendrath | 2/20 X |
| 2,603,790 | 7/1952 | Boehm-Myro | 2/160 X |
| 2,792,827 | 5/1957 | Gravin et al. | 2/159 X |
| 4,535,482 | 8/1985 | Spector et al. | 2/161 A X |
| 4,587,672 | 5/1986 | Madnick et al. | 2/158 |
| 4,670,909 | 6/1987 | Forrester | 2/160 |
| 4,727,602 | 3/1988 | Giese et al. | 2/160 X |
| 4,742,579 | 5/1988 | Dunford | 2/160 |
| 4,759,084 | 7/1988 | Madnick et al. | 2/160 X |
| 5,035,003 | 7/1991 | Rinehart | 2/159 |

FOREIGN PATENT DOCUMENTS

| | | | |
|---|---|---|---|
| 543548 | 3/1942 | United Kingdom | 2/159 |
| 2118023 | 10/1983 | United Kingdom | 2/158 |

*Primary Examiner*—Andrew M. Falik
*Assistant Examiner*—Sara M. Current
*Attorney, Agent, or Firm*—Peter D. Aufrichtig

[57] ABSTRACT

A heated garment such as a mitten, glove or sock, for heating at least a portion of the body part with a heater pack. The mitten, glove or sock covers at least a portion of a body part and has at least one opening for insertion of the body part. A chamber assembly is coupled to the inside of the garment for creating an elongated chamber in the garment accessible through the garment opening. A pocket assembly is coupled to the garment for receiving the heater pack and is adapted to be removably inserted to the elongated chamber. Inserting the pocket assembly with the heater pack into the elongated chamber of the garment transmits heat to the wearer's covered body part in an efficient fashion without unnecessarily restricting mobility or increasing bulkiness.

14 Claims, 3 Drawing Sheets

GLOVE WITH ATTACHED HEATER PACK

BACKGROUND OF THE INVENTION

The invention is directed to a heated garment and in particular to a heated mitten, glove or sock incorporating a heater pack.

Various attempts have been made to insure that mittens and gloves keep the wearer's hands warm without adding excessive bulkiness or restricting movement. In this pursuit various new insulating materials and waterproof membranes, such as GORE-TEX and WATERGUARD have been developed and utilized in mittens and gloves to maximize heat retention while retaining flexibility.

There is, however, a substantial need for gloves, mittens and socks which include either a one-time or reusable heater pack to heat the glove, mitten or sock. The heater packs are one-time or reusable sealed containers holding chemicals or solutions that either react when exposed to the air or to solutions which are separated in the container until ready for use. Heater packs of various sorts are well known and any of the various types of heater packs can be utilized in accordance with the invention.

The heater packs were originally used in gloves or mittens by dropping them into the glove or mitten to heat the interior of the glove. The major disadvantage of this approach is that the heater packs were uncomfortable because the heater packs were not fixed in a spot and moved around. Heater packs used in this way get too close to the hand, or even touch the bare hand, causing discomfort and even burns because they are too hot. In addition, the chemicals producing the heat can irritate the skin.

Thereafter, to solve this problem pockets were developed to hold the heater packs in gloves or mittens. These pockets are either on the back or palm of the gloves and mittens. Zippers or mating hook and pile VELCRO enclosures are used to close the pockets. One problem with this kind of glove or mitten is that the openings are at the expense of some heat loss from the heater packs and from the inside of the glove. The heat loss is due to the need to cut both the outer shell of the glove and the insulating layer to make the pocket. Where the insulating barrier is not cut and the pocket is formed under the shell only, the heat generated has difficulty getting to the hand.

With the advent of waterproof membranes such as GORETEX and WATERGUARD, the difficulties and problems associated with the making of a pocket under the waterproof barrier is increased. The waterproof membrane inserts, which are generally extremely thin and fragile as a result of the fragility of these waterproof inserts, are generally added to the glove or mitten covering the completely sewn lining. This makes it even more difficult to cut a pocket through this membrane layer of the glove in the construction and in the assembly. In addition, where the waterproof membrane is cut, the benefits of the waterproof membrane in keeping the wearer's hand dry from outside moisture is significantly reduced.

In addition, there have been various attempts to use heater packs in socks. These efforts have suffered from some of the same problems. Loose heater packs on the inside of the sock are prone to burn the wearer's foot and move around which is likely to cause discomfort.

Accordingly, there is a need for a garment such as a mitten, glove or sock which incorporates a heater pack which will stay proximate to the wearer's fingertips or toes which are most sensitive to the cold, do not cause discomfort because of contact or movement in use and are easy to manufacture and assemble.

SUMMARY OF THE INVENTION

The invention is generally directed to a heated garment for heating at least a portion of a body part with a heater pack. The garment covers at least a portion of a body part and has at least one opening for insertion of the body part into the garment. A chamber structure is coupled to the inside of the garment for creating an elongated chamber in the garment accessible through the opening. A pocket member coupled to the garment is adapted to receive the heater pack and to be removably inserted into the elongated chamber. Insertion of the pocket member with a heater pack, into the chamber of the garment transmits heat to the wearer's covered body part portion.

The invention is also generally directed to a heated mitten, glove or sock for heating at least a portion of a hand or foot, respectively, with a heater pack. The mitten, glove or sock has a chamber structure which is coupled to the inside of the garment for creating an elongated chamber in the garment accessible through the hand opening or the opening in the respective garment. A pocket member is coupled to the inside of the garment for receiving the heater pack. The pocket member is adapted to be removably inserted into the elongated chamber so that the heater pack is proximate the hand or foot, respectively. When the pocket with a heater pack is inserted into the chamber of the garment it transmits heat to the wearer's covered hand or foot.

Accordingly, it is an object of the instant invention to provide improved heated garments for heating at least a portion of a body part with a heater pack.

A further object of the invention is to provide an improved heated garment utilizing a disposable heater pack which transmits heat energy substantially directly to the most heat sensitive portions of a wearer's hands, feet or other body parts while retaining flexibility of the garment and restricting bulkiness of the garment covering the body part.

Still another object of the invention is to provide an improved heated mitten for heating the finger tips of the wearer's hand with a heater pack in a removable pocket which inserts into a chamber in the mitten and which maintains the heater pack proximate the wearer's fingertips.

Yet another object of the invention is to provide an improved glove which warms the wearer's fingers and hand with a heater pack which is easily removable and does not interfere with the flexibility of the glove or unnecessarily increase the bulkiness of the glove.

Still a further object of the invention is to provide a heated mitten which places a heater pack for warming the wearer's fingers inside a waterproof membrane without cutting the waterproof membrane and breaching the waterproof barrier provided thereby.

Still another object of the invention is to provide an improved glove or mitten which heats the wearer's fingers and increases the transmittance of heat and aids combustion of the heater pack by utilizing a mesh section between the heater pack and the wearer's fingers and also provides a reflective layer on the back surface of the heater pack to reflect heat toward the wearer's fingers.

Yet a further object of the invention is to provide an improved heated sock which provides the wearer's toes with warmth and maximizes heat transmission while preventing burns or discomfort due to excessive heat.

Still another object of the invention is to provide a heated garment for heating at least a portion of the body part with a heater pack with a pocket for holding the heater pack being freely slidable into a chamber so that the heater pack is positioned proximate the desired portion of the wearer's covered body part.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
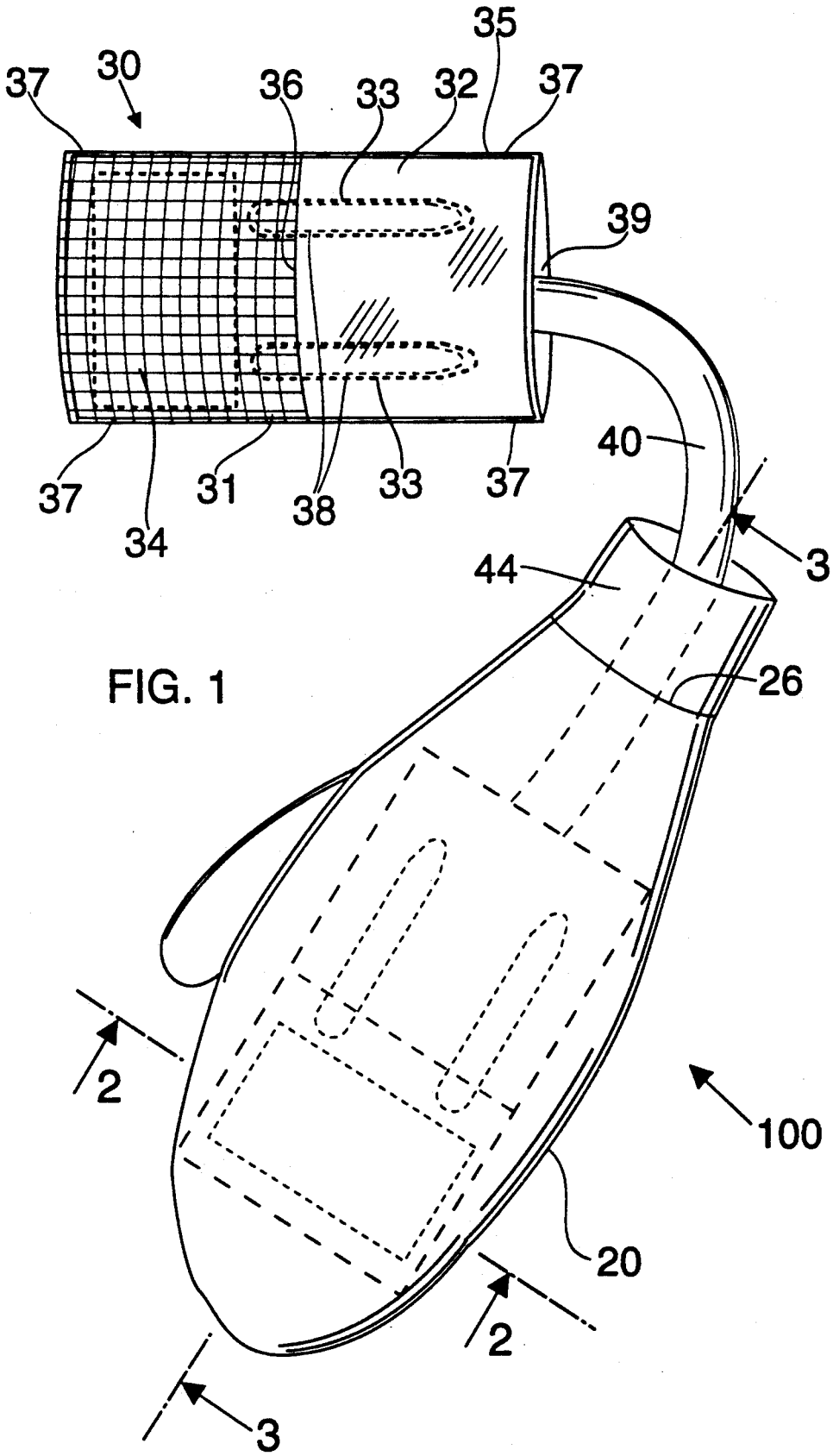
FIG. 1 is a perspective view of a mitten constructed in accordance with a preferred embodiment of the invention.
Figure 2:
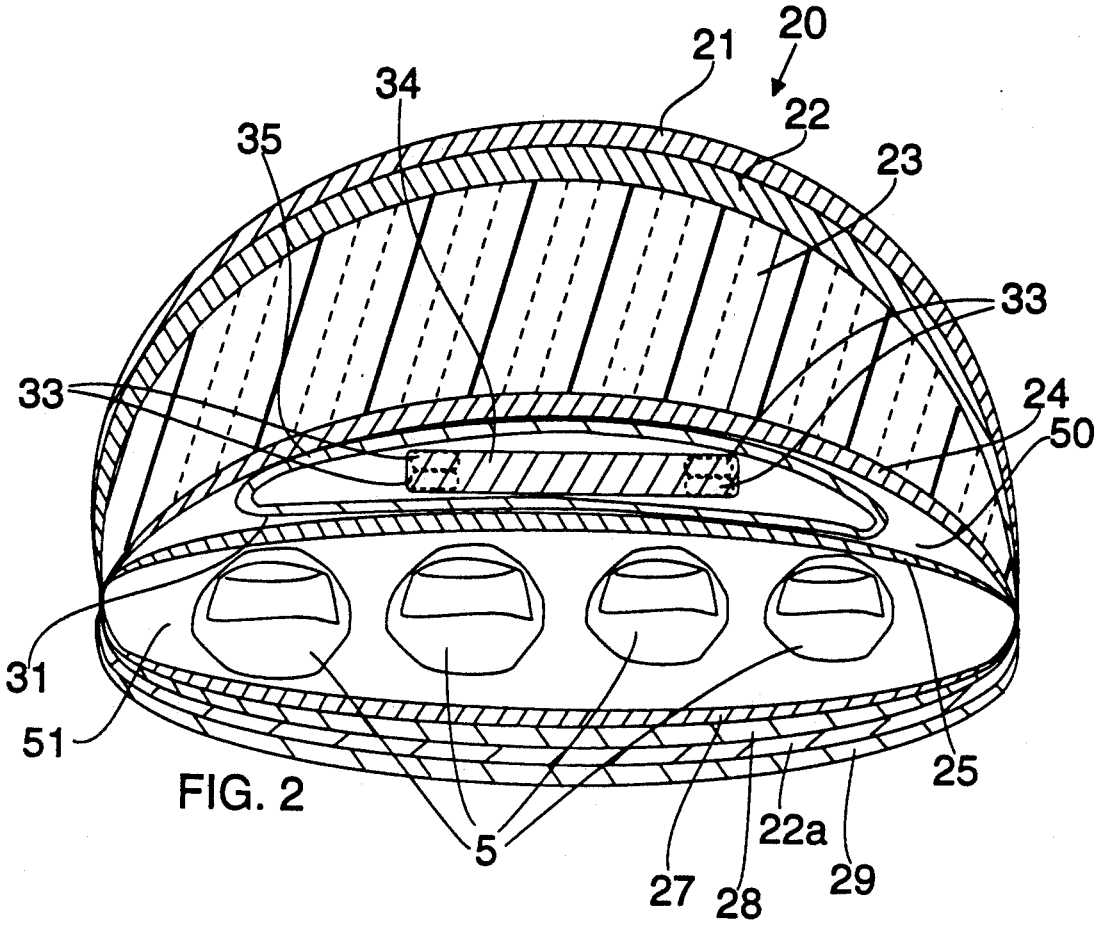
FIG. 2 is a cross-sectional view taken along line 2—2 of FIG. 1.
Figure 3:
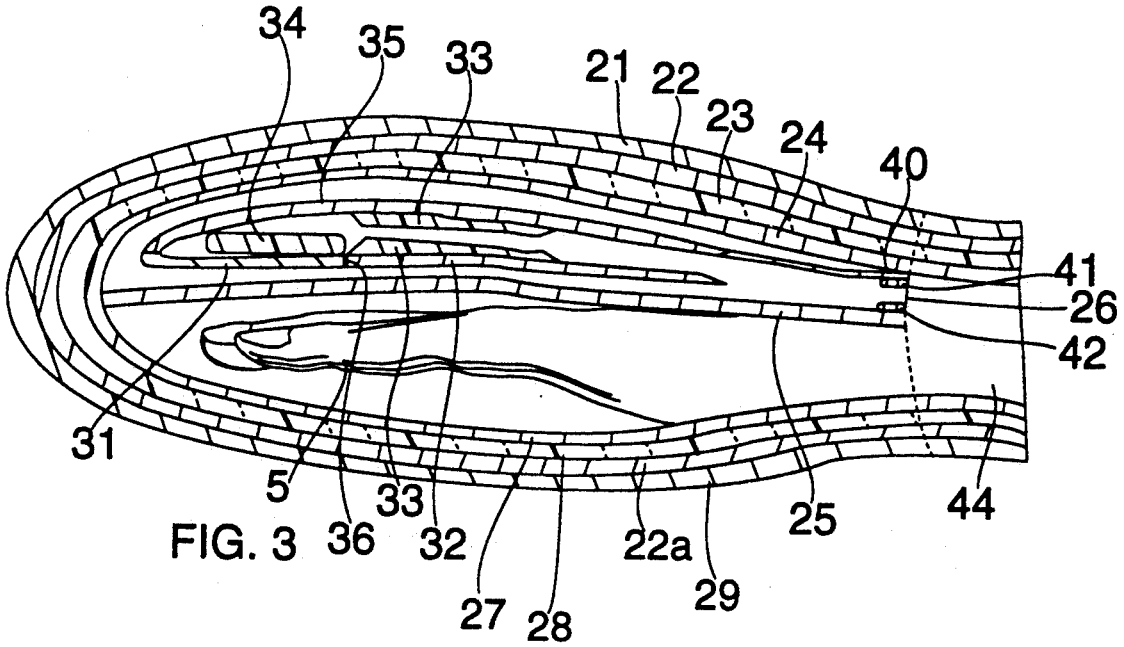
FIG. 3 is a cross sectional view taken along line 3—3 of FIG. 1.

Reference is made to FIGS. 1-3 wherein a mitten, generally indicated as 100 in accordance with a preferred embodiment of the invention is depicted. Mitten assembly 100 includes mitten 20, removable heater pack pocket 30 and connector strap 40 for connecting heater pack pocket 30 to mitten portion 20.

Mitten 20 as best seen in FIGS. 2 and 3 includes upper outer shell 21, upper waterproof membrane layer 22, upper insulation layer 23, upper chamber layer 24, lower chamber layer/upper-inner layer 25, lower inner layer 27, lower insulation layer 28, lower waterproof membrane layer **22*a* and lower outer shell 29. Upper and lower chamber walls 24, 25 form a chamber 50 for receiving heater pad pocket 40. Likewise, layers 25, 27 define a finger receiving cavity 51 for receiving fingers 5 when the wearer's hand is inserted into mitten 20. Heat pack pocket 30, seen best in FIGS. 1 and 3, is a generally rectangular pocket attached to the inside of mitten 20 proximate wrist seam 26 by strap 40. Heater pack pocket 30 is formed of three sheets of material 31, 32, 35. Sheet 31 is preferably a mesh, cotton, synthetic or combination weave which allows for heat transmission. Sheet 32 may be formed of a nylon material to reduce the weight and friction and to maintain flexibility. Sheets 31, 32 are sewn together with a seam 36. Sheet 35, shown in FIGS. 2 and 3, is substantially the same size as the attached pieces 31, 32 and is sewn around three of its four edges with seam 37. One narrow end is left open to form open end 39 of the pocket. Layer 35 is formed with a reflective silver coating on a tricot nylon material to reflect the heat in the direction of the open mesh membrane 31. Other reflective materials may be substituted. In addition, four stays 33 are sewn to sheet 31, 32, 35 by stitching 38. Stays 33 are sewn to the upper and lower surfaces of heater pack pocket 30 in a fashion to define a region between the end of the stays and the closed end of the pocket where heater pack 34 resides. Stays 33 are preferably flexible members such as plastic shirt collar stays which retain heater pack pocket 30 in a generally flat and extended form when within chamber 50**.

Heater pack pocket 30 is stitched to one end of a nylon strap 40. The other end of nylon strap 40 is secured to wrist seam 26. A mating hook and pile fastener 41 is sewn to nylon strap 40 proximate its connection to wrist seam 26. A mating hook and pile fastener 42 is sewn to the upper surface of lower chamber wall 25 so that it will mate with fastener 41 when pocket 30 is fully inserted in chamber 50.

Mitten 20 is assembled by stitching together layers 24, 25 and 27 which form finger cavity 51 and chamber 50. Next, insulation or wadding layers 24, 28 are added to the glove. Next, waterproof membrane layers 22, **22*a*, which are particularly fragile and subject to damage from handling are sealed together to form a mitten shaped sheath and slid over wadding layers 23, 28. Finally, outer shell 21, 29 is slid over waterproof membrane 22, 22*a* and the final stitching to secure these layers to the interior of the mitten is completed. This stitching includes wrist seam 26. Heater pack 40 is assembled separately by sewing the various pieces 31, 32, 35 and sewing stays 33 in place. Nylon strap 40 with hook and pile fastener 41 is secured to mitten 20 at wrist seam 26 when wrist cover 44 is sewn to layers 21, 22, 23 24. Then, heater pack pocket 30 is sewn to the free end of strap 40**.

In the embodiment of mitten 100, the thumb portion is treated in a conventional fashion and, for ease of discussion the construction and assembly of the thumb portion is omitted.

To place a heater pack 34 in heater pack pocket 30, a wearer of the mitten 100 would first take the mitten off of his or her hand. Next, assuming that heater pack pocket 30 is present in chamber 50, either without a heater pack 34 or with an exhausted heater pack 34. First, the wearer would separate hook and pile connector pads 41, 42 to open chamber 50. Next, the wearer would loop his or her finger around nylon strap 40 and pull heater pack pocket 30 out of chamber 50. Although stays 33 cause pocket 30 to tend to stay flat within chamber 50, as pocket 30 is pulled out of chamber 50 it will bend as necessary to allow the pocket to completely exit mitten 20 and extend outward as shown in FIG. 1.

Then, the old heater pack 34 can be easily removed from pocket 30 and the new heater pack 34 slid into opening 39 and into the position shown in FIG. 1 where it will be proximate the wearer's fingers after insertion into mitten 20. Generally, new heater pack 34 will be activated either by a mixing of the chemicals to start the chemical reaction which causes heat to be produced or other initiation procedure prior to placing heater pack 34 into pocket 30. Stays 33 define a region for heater pack 34 between the end of the stays and the closed end of pocket 30 where the heater pack will stably remain situated. Additional structures can be utilized to fix the heater pack in place within the pocket although the disclosed structure effectively maintains the heater pack in place under actual use conditions.

Next, the closed end of pocket 30 is inserted into the open end of chamber 50 with reflective layer 35 oriented facing upward and away from the location of the wearer's fingers. The open weave mesh is oriented downward or toward the wearer's fingers. Once the pocket 30 is pushed into chamber 50, vigorous shaking of mitten 20, from the wrist portion 44, forces pocket 30 into its inserted position as shown in FIG. 3. Here again, stays 33 assist in the proper placement of pocket 30 within chamber 50 as they cause pocket 30 to flatten out and thus fill pocket 50 with heater pack 34 and open mesh portion 31 being over the wearer's fingertips.

After pocket 30 is firmly seated in chamber 50, mating hook and pile fasteners 41, 42 are pressed against each other to seal off chamber 50. This has two benefits. First, the closing of chamber 50 acts to prevent heat from leaking out of the open end of chamber 50. Second, and of equal importance, is the smooth entrance to cavity 51 for the wearer's fingers and hand. By closing chamber 50 so that there is no lip or opening for the wearer to mistakenly slide his fingers into, the possibility of ripping chamber 50 or injuring the fingers 5 during insertion of the hand into mitten 20 is prevented. With chamber 50 closed by the mating connecting numbers 41, 42, the mitten presents an interior substantially identical to a normal mitten.

A major source of dissatisfaction with gloves and mittens is tied to the heightened sensitivity to cold of the fingertips and surrounding portions of the fingers. As a result, traditional mittens and gloves have provided ample warmth to the palm and finger crutch area between the fingers but have failed to provide adequate warmth around the wearer's fingers and specifically in the fingertip regions. The fingertip regions are furthest from the hand and close to the exterior of the glove. Attempts to uniformly insulate the gloves to assure warmth of the fingertips unnecessarily overheats the other portions of the hand and provides a mitten or glove which is too bulky for practical purposes.

A heater pack arrangement constructed in accordance with the invention places the required heat where it is needed, i.e., around the ends of the fingers, so that a lighter weight glove or mitten which is not as bulky can be utilized in very cold environments.

The mitten arrangement constructed in accordance with the invention, utilizing the chamber, pocket, stays and heater pack, assures that the wearer's fingertips are heated in an efficient and safe fashion. The use of a soft mesh, such as a cotton rachelle knit mesh further aids in the heat transmission. Other natural, synthetic or hybrid materials may be used to form the mesh. The mesh has the advantage of providing free passage through the air of the heat from the heater pack to the bottom surface of the heater pocket chamber which also serves as the top surface of the finger cavity in order to maximize heat transmission from the heater pack to the wearer's fingers. In a further embodiment this layer is formed of a woven nylon, which aids in the transmittance of heat and protects the wearer's hand from contacting the heater pack. The mesh also allows air to reach the heater pack. Some of the commercially available heater packs require exposure to air for regeneration. In this way the heater pack can more efficiently generate heat.

The heated mitten construction in accordance with the invention provides the heat source inside of the insulation and waterproof membrane as well as the outer shell. This is accomplished without the need for cutting the waterproof membrane, as is necessary in prior art formulations which include a pocket accessible directly from the outside of the mitten. Notwithstanding the fact that there is no pocket directly accessible from the outside surface of the mitten, the strap and heater pack pocket arrangement is easily accessible and easily returned to its desired position within the chamber so that heat is directed to the fingertip region of the wearer's hand.

The mitten is shown with the heater pack and pocket floating relatively freely within the chamber. The materials on the walls of the chamber are selected so as to allow sliding of the pocket within the chamber. This sliding motion minimizes any restriction of hand movement that may develop where materials are fixed to the glove where the hand flexes. In the preferred embodiment described above, the pocket is attached to the mitten only through the strap, which itself is only fixed to the hem of the wrist.

The chamber is shown on the upper portion of the mitten, i.e., above the fingers and against the back of the wearer's hand. This approach minimizes any restrictions to movements of the hand and gripping potential of the mitten. It is, however, possible to apply applicant's invention to place the chamber and the pocket against the bottom surface of the wearer's hand (i.e., the palm). This approach is at least equally efficient in transmitting heat to the wearer's hand. However, this approach may restrict the wearer's flexibility in the glove and interfere with the gripping action.

Figure 4:
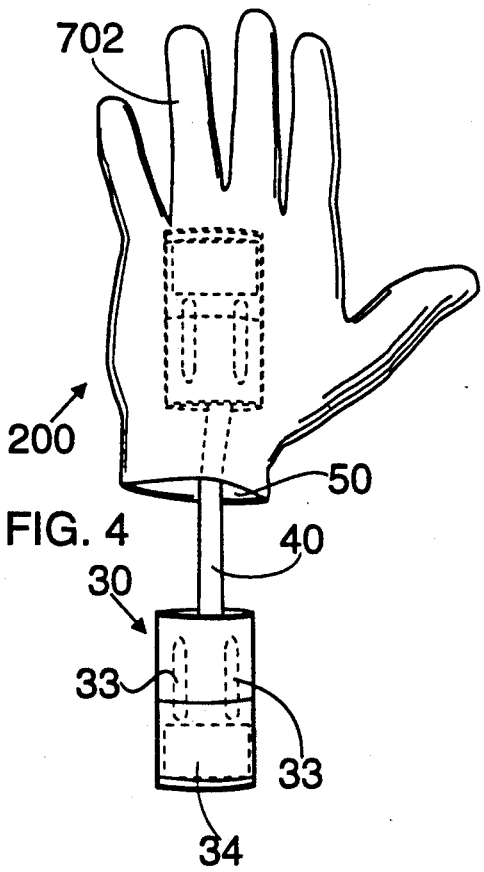
FIG. 4 is a perspective view of a glove constructed in accordance with a preferred embodiment of the invention.

Reference is next made to FIG. 4 wherein a glove 200 constructed in accordance with a preferred embodiment of the invention is depicted, like reference numerals corresponding to like elements. Glove 200 includes a heater pack pocket 30 and strap 40 constructed in the same fashion as that disclosed in the embodiment of FIGS. 1-3. Likewise, strap 40 is connected to the wrist seam of glove 200 and a similar chamber, as is shown in FIGS. 2 and 3, is created with similar layers of material. Chamber 50 in glove 200 extends up to the crotch region of the glove between the bases of the fingers 202 so that the flexibility of the fingers is not impaired. Heater pack 34 resides over the knuckles of the hands and heater pack 34 generates sufficient heat to heat the fingers and the remaining portion of the hand.

Glove 200 includes each of the other elements of mitten 100. As with mitten 100, with glove 200, to remove the heater pack it is necessary to open the mating hook and pile fasteners 41, 42, pull on strap 40 so that heater pack pocket 30 exits cavity 50 and extends as in FIG. 1 outside glove 200. To reinsert the pocket 30 with a new heater pack one repeats the same steps in reverse, sliding heater pack pocket 30 into the opening of chamber 50. Then, pocket 30 is pushed in as far as possible by hand and the glove shaken vigorously while holding on to the wrist seam. Between the force exerted by the shaking and the straightening effect of stays 33, pocket 30 moves up against the ends of chamber 50 proximate the crotch region of glove 200.

Figure 5:
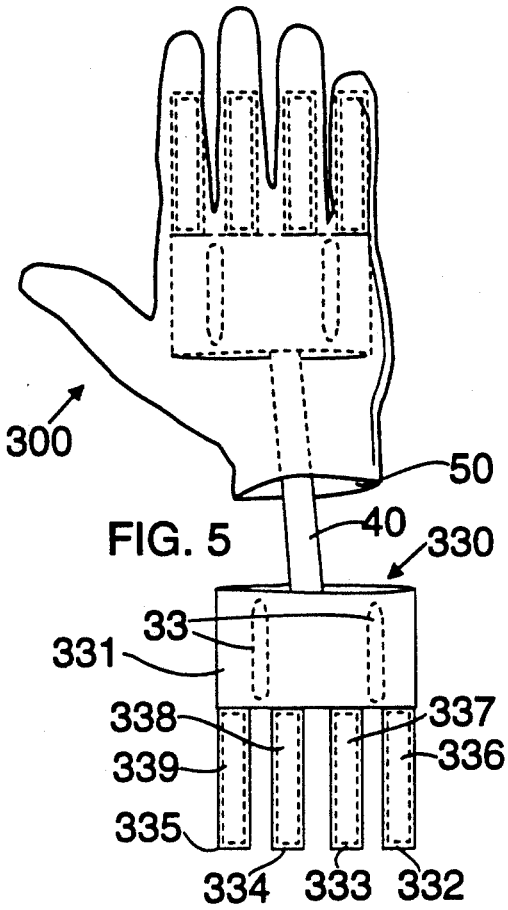
FIG. 5 is a perspective view of a glove in accordance with another preferred embodiment of the invention.

Reference is next made to FIG. 5 wherein a heated glove, generally indicated as 300 constructed in accordance with another preferred embodiment of the invention is depicted. Like elements are represented by like reference numerals. Glove 300 includes similar layers as are shown in FIG. 2 and 3. However, the chamber 50 extends into the finger regions of glove 300.

Glove 300 includes a heater pack pocket 330 which fits into chamber 50. Heater pocket 330 includes a generally rectangular portion 331 and finger regions 332, 333, 334, 335 for receiving small rectangular heater packs 336, 337, 338, 339. Pocket 330 includes stays 33 to maintain the flat orientation of item 330 when inside chamber 50 in glove 300. Utilizing the structure of glove 300, heat can be transmitted directly to each of the fingers on the wearer's hand without unnecessarily restricting the flexibility of the glove.

The various layers of material and steps of construction of strap 40 and chamber 50 are the same as are disclosed in FIGS. 1–4.

Figure 6:
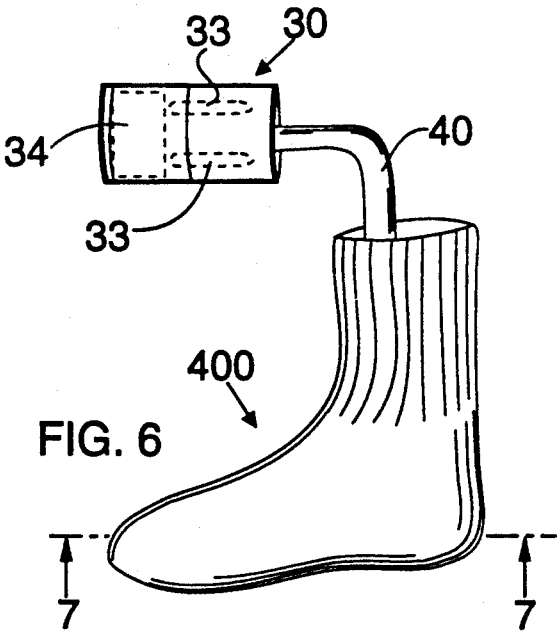
FIG. 6 is a perspective view of a sock constructed in accordance with another embodiment of the invention.
Figure 7:
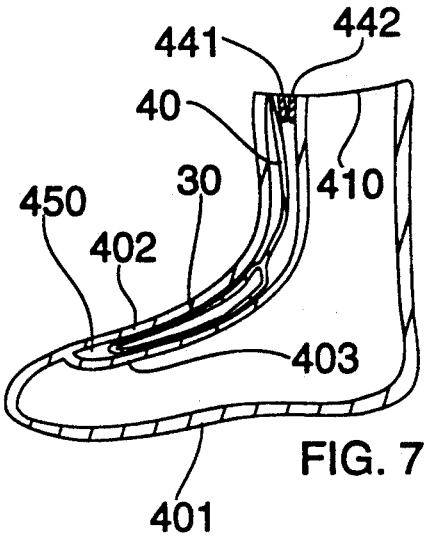
FIG. 7 is a sectional view taken along line 7—7 of FIG. 6.

Reference is next made to FIGS. 6 and 7 wherein a sock, generally indicated as 400 is constructed in accordance with another preferred bottom of the invention is depicted. Sock 400 includes lower outer wall 401, upper outer wall 402, and an inner chamber wall 403. A strap 40 is connected near the foot opening on upper outer wall 402 and is also connected on its other end to pocket 30 which is constructed in accordance with the pocket 30 disclosed above in the embodiments of FIGS. 1–4. Mating hook and pile connectors 441, 442 are found on strap 40 and on the lower chamber wall 403. With pocket 30 in chamber 450 formed between walls 402, 403, sock 400 presents an opening 410 which is the same as a standard sock. Chamber 450 is sealed and there is no apparent opening which might mistakenly receive the wearer's foot when the sock is put on. Chamber 450 is shown on top of the wearer's foot so that the geometry of the foot is not changed and shoes, sneakers and boots will still fit normally. However, if desired, chamber 450 can be configured on the bottom of sock 400 by wall 401 and 403.

In addition, other types of garments covering other portions of the wearer's body can be utilized. Jackets, knee guards, elbow guards, hats, headbands, pants, shirts, sweaters, shoes and boots as well as other garments can be modified in accordance with the invention to provide heat with a heater pack contained in a pocket which is removably insertable into a chamber proximate a body part requiring heating.

Accordingly, an improved heated garment for heating at least a portion of the body part with a heater pack constructed in accordance with the invention is provided. The garment is adapted to cover at least a portion of a body part and has at least one opening for insertion of the body part. A chamber assembly is coupled to the inside of the garment for creating an elongated chamber in the garment means which is accessible through the opening. A pocket assembly is coupled to the garment for receiving the heater pack and is adapted to be removable if inserted into the elongated chamber. The insertion of the pocket with a heater pack in the chamber of the garment transmits heat to the wearer's body part portion.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

it is also to be understood that the following claims are intended to cover all of the generic and specific features of the invention herein described and all statements of the scope of the invention which, as a matter of language, might be said to fall therebetween.

What is claimed is:

1. A heated garment for heating at least a portion of a body part with a heater pack comprising:

garment means for covering at least a portion of a body part, said garment means having at least one opening for insertion of the body part;

chamber means coupled to the inside of the garment means for creating an elongated chamber in the garment means accessible through the opening pocket means coupled to the garment means for receiving the heater pack and adapted to be removably inserted into the elongated chamber wherein the pocket means includes a two walled pouch with an opening for receiving the heater pack and a strap having a first end coupled to the pouch and a second end coupled to the garment means;

whereby the insertion of the pocket means with the heater pack into the elongated chamber of the garment transmits heat to the wearer's covered body part portion.

2. The heated garment of claim 1 wherein the garment means includes a mitten.

3. The heated garment of claim 2 wherein the pocket means includes stiffening means for retaining the pocket means in a flat orientation when the pocket means is inserted in the chamber means.

4. The heated garment of claim 3 wherein the stiffening means includes at least one flexible stay.

5. The heated garment of claim 2 wherein the wall of the pouch adapted to be closer to the wearer's hand includes a mesh section.

6. The heated garment of claim 2 wherein the wall of the pouch adapted to be further away from the wearer's hand includes a heat reflective layer.

7. The heated garment of claim 2 wherein the chamber means includes a first wall forming at least a portion of the inner surface of the mitten and a second wall coupled to the first wall.

8. The heated garment of claim 1 wherein the garment means includes a glove.

9. The heated garment of claim 1 wherein the pocket means includes stiffening means for retaining the pocket means in a flat orientation when the pocket means is inserted in the chamber means.

10. The heated garment of claim 9 wherein the stiffening means includes at least one flexible stay.

11. The heated garment of claim 1 wherein the wall of the pouch adapted to be closer to the body part includes a mesh section.

12. The heated garment of claim 1 wherein the wall of the pocket adapted to be further away from the body part includes a heat reflective layer.

13. The heated garment of claim 1 further comprising chamber closing means coupled to the chamber means and the pocket means for closing the elongated chamber opening when the pocket means is in the chamber.

14. The heated garment of claim 1 wherein the chamber means includes a first wall forming at least a portion of the inner surface of the garment means and a second wall coupled to the first wall.

* * * * *